United States Patent [19]

Scott et al.

[11] Patent Number: 4,983,123

[45] Date of Patent: Jan. 8, 1991

[54] MARKSMANSHIP TRAINING APPARATUS

[75] Inventors: Bentley N. Scott, Richardson; Samuel R. Shortes, Lewisville, both of Tex.

[73] Assignee: Phase Dynamics, Inc., Richardson, Tex.

[21] Appl. No.: 431,902

[22] Filed: Nov. 6, 1989

[51] Int. Cl.[5] ..... F41G 3/26

[52] U.S. Cl. ..... 434/21; 434/19; 362/111

[58] Field of Search ..... 434/21, 19, 16; 362/110, 111, 113

[56] References Cited

U.S. PATENT DOCUMENTS

| | | | |
|---|---|---|---|
| 3,471,945 | 10/1969 | Fleury | 434/21 |
| 3,938,262 | 2/1976 | Dye et al. | 434/21 |
| 4,136,956 | 1/1979 | Eichweber | 362/111 X |
| 4,234,911 | 11/1980 | Faith | 362/111 |
| 4,416,630 | 11/1983 | Hagen et al. | 434/21 X |
| 4,678,437 | 7/1987 | Scott et al. | 434/21 |
| 4,830,617 | 5/1989 | Hancox et al. | 362/111 X |

FOREIGN PATENT DOCUMENTS

| | | | |
|---|---|---|---|
| 2414185 | 9/1979 | France | 362/111 |
| 2445505 | 8/1980 | France | 434/21 |

*Primary Examiner*—Richard J. Apley
*Assistant Examiner*—Jennifer L. Doyle
*Attorney, Agent, or Firm*—Timmons & Kelly

[57] ABSTRACT

Marksmanship training apparatus is used with air guns or weapons firing blank cartridges and comprises a housing member with an attached muzzle alignment tube for insertion into the bore of the barrel of the weapon and includes sealing apparatus around the muzzle alignment tube to minimize leakage of gas between the bore and the muzzle alignment tube and to prevent the gas from pushing the muzzle alignment tube out of the bore. The housing member includes a switch which is activated by the gas to complete an electrical circuit positioned in the housing to cause light energy to be emitted from the housing member.

20 Claims, 4 Drawing Sheets

MARKSMANSHIP TRAINING APPARATUS

BACKGROUND OF THE INVENTION

1. Field of the Invention

The present invention relates in general to new and improved apparatus for use in marksmanship training. More particularly, but not by way of limitation, this invention relates to apparatus for removably mounting on small firearms and the like to project a beam of light onto the spot where the firearm is aimed at the time the firing mechanism of the firearm is activated.

2. Description of the Prior Art

It is well known that the best way to develop firearms marksmanship is actual firing at the target where the results are immediately visually perceptible. The firing of live ammunition is expensive, noisy, incurs certain risks and may just not be feasible in certain situations.

Various prior art devices have been devised which substitute the emission of light for the discharge of live ammunition to train one in the accurate aiming and firing of various types of firearms. Unfortunately, many of the prior art devices suffer from one or more major limitations. For example, many such devices are bulky, unwieldy and otherwise difficult to use. Many require modification of the firearm to accept the training device and render the firearm (at least temporarily) inoperative to fire live ammunition. None are known at this time which operate with air rifles or pellet guns.

Some of the prior art devices use laser implementation with their inherent dangers, particularly to eye damage. For example, U.S. Pat. No. 3,938,262 discloses a laser weapon simulator for firing a laser pulse in response to the firing of a blank cartridge. Pawls are attached to the housing of the simulator which is attached to the rifle by clamping onto the flash suppressor. U.S. Pat. No. 4,678,437 discloses a self-contained substitute cartridge which emits a pulse of light upon closure of a switch resulting from energy received from the firing pin of the firearm. U.S. Pat. No. 4,234,911 discloses an optical apparatus adapted for insertion into the open end of a hand-gun barrel. A piezoelectric crystal produces an output signal in response to the hammer impact to cause an LED to output a pulse of light. U.S. Pat. No. 3,367,516 discloses a radiant energy emitting unit for a cartridge cylinder of a revolver and an elongated lens tube adapted to be received within the barrel. U.S. Pat. No. 3,510,965 discloses an electrically actuated light bulb and focusing lens which inserts into the barrel of a revolver. When the trigger is pulled, the firing pin strikes the cartridge unit in the chamber for completing the electrical circuit.

This invention is intended to provide a solution to various prior art deficiencies which include the requirement to make a temporary modification of the weapon. Some prior art units use laser light with its inherent danger. The prior art does not provide for marksmanship training apparatus to be used with air rifles or pellet guns.

SUMMARY OF THE INVENTION

The present invention provides apparatus for simulated firing of projectile-type weapons using air or gas from a blank cartridge and comprises a housing member with an attached muzzle alignment tube having a passageway therethrough and structured to be inserted into the bore of the barrel of a weapon. Sealing means are positioned around the muzzle alignment tube to minimize gas being propelled down the bore from passing between the muzzle alignment tube and the bore and to prevent the muzzle alignment tube from being pushed out of the bore by the gas. The housing member has positioned therein an electrical circuit which includes an energy emitting means, a lens, a power source, an energy activation device and a transfer device. The housing member also includes a chamber positioned between the transfer device and the muzzle alignment tube to receive the gas from the bore, allow some of the gas to apply a force to the transfer device and complete the electrical circuit to cause the energy emitting means to emit light energy and then provide means to expel the remaining gas to the outside atmosphere through ports in the chamber.

In another aspect, the present invention provides a housing member with an attached muzzle alignment tube and sealing means positioned around the muzzle alignment tube. The housing member includes a chamber therein which is structured to receive a simulated cartridge which contains the electrical circuit for emitting energy when an energy activation device therein is activated by gas (which includes air) from the weapon.

Among the advantages offered by the present invention is a self-contained device which does not require any changes to be made to the weapon. The present invention can be used with any weapon. The present invention is axially disposed in the bore of the barrel for accurate boresighting.

Figure 8:
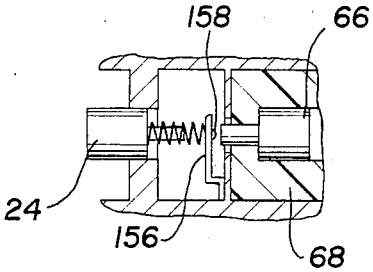

FIGS. *6a* and *6b* are simplified elevational views of a portion of the marksmanship training apparatus showing embodiments of the vent openings of the present invention;

FIGS. *7a* and *7b* are an enlarged simplified side elevational view and an enlarged end view of means for adjusting the size of the vent opening; and FIG. 8 is a simplified side elevational view of an additional embodiment of the energy activation means of the present invention.

DESCRIPTION OF THE PREFERRED EMBODIMENT

Although the present invention is applicable for use with various weapons, it has been found to be particularly useful in connection with a pneumatic type weapon such as an air rifle, air gun, pellet gun, etc. which uses air pressure from a pump means attached to the weapon or compressed air from a cartridge. Therefore, without limiting the applicability of the invention to an air rifle, air gun or pellet gun, the invention will be described in that environment. It will be appreciated that the present invention may also be used with weapons which can load and fire blank cartridges.

Figure 1:
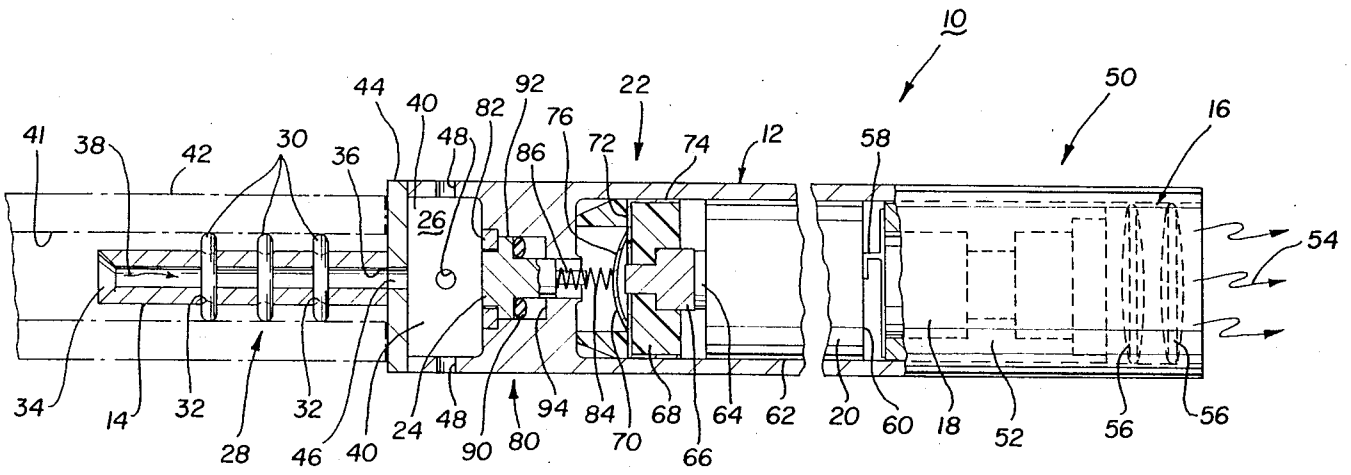
FIG. 1 is a simplified elevational view, partially in section, of the marksmanship training apparatus that is constructed in accordance with the present invention.

Referring to the drawing and to FIG. 1 in particular, shown therein and generally designated by the reference numeral 10 is marksmanship training apparatus which is constructed in accordance with the invention. Marksmanship training apparatus 10 includes a housing member 12 with an attached muzzle alignment tube 14 extending therefrom. Housing member 12 encloses lens means 16, energy emitting means 18, a power source 20, energy activation means 22, a transfer mechanism 24 and a chamber 26.

Muzzle alignment tube 14 is a tubular shaped member which includes sealing means 28 positioned around the outside of the muzzle alignment tube 14. In the preferred embodiment, sealing means 28 comprises a predetermined number (one or more) of O-rings 30 positioned in grooves 32 formed in the outer surface of muzzle alignment tube 14. Muzzle alignment tube 14 includes entry and exit ports 34 and 36, respectively, for conveying gas or gas pressure 38 and gas shock waves 40 from an air gun or from a blank cartridge, being fired in a gun, to chamber 26. Entry port 34 may be countersunk for providing a smooth transition for the gasses 38 and the gas shock waves 40 as they pass from the bore 41 of barrel 42 to the muzzle alignment tube 14.

In the preferred embodiment, housing member 12 is generally cylindrical in shape (but is not so limited to such shape) and is electrically conductive. Housing member 12 includes an end plate 44 with a centrally located opening or aperture 46. The muzzle alignment tube 14 and the housing member 12 are axially connected at the exit port 36 and the opening or aperture 46, respectively. Several openings 48 are located around the circumference of the housing member 12 near end plate 44. Openings or exhaust ports 48 allow the spent gasses 38 to escape from the barrel 42 through chamber 26.

Energy emitting means 18 and lens means 16 are positioned and maintained in a first end 50 of the housing member 12 by holder 52. In the preferred embodiment, energy emitting means 18 comprises a light emitting diode which emits a pulse of light when activated. It is important that the pulse of light has a rise time of less than 8 milliseconds. Some typical light emitting diodes for use in the present invention are TRW OP 123 or Honeywell SE5470-4. Lens means 16 may be a separate element or may be combined with the energy emitting means 18 to be a part thereof and be a single unit. Lens means 16 should be of a type which will tend to collimate and/or concentrate the pulses of light energy 54 which are emitted from energy emitting means 18. Lens means 16 may comprise one or more individual lens 56.

One terminal of the energy emitting means 18 is connected to the housing member 12 through the housing of the energy emitting means 18 which is mounted in a pressure fit in the holder 52. Holder 52 is electrically conductive and is mounted by conventional means such as threaded, pinned, etc. in first end 50 of housing member 12. The other terminal 58 of the energy emitting means 18 is in contact with a first terminal 60 of the power source 20. Power source 20 could be any suitable battery, such as the DURACELL D393. The power source 20 is insulated from the housing member 12 by insulation 62. The second terminal 64 of the power source 20 is connected by pressure contact to energy activation means 22. In the preferred embodiment (other embodiments will be discussed below), energy activation means 22 is a snap-action type switch (a dome switch) and comprises stationary terminal 66 which is supported by insulation means 68. Contact ring 70 fits within cutout 72 formed in insulation means 68. Contact ring 70 is electrically conductive and includes tabs 74 which are positioned at right angles to the main body of contact ring 70 to contact housing member 12. Movable terminal 76 is seated around its periphery on contact ring 70. In the preferred embodiment, although not limited thereto, movable terminal 76 comprises a domed or cupped disc whose center is displaced when pressure is applied thereto. When movable terminal 76 is displaced such as to contact stationary terminal 66, energy emitting means 18 is activated and emits a pulse or pulses of light energy 54.

Transfer mechanism 24 is positioned in the second end 80 of housing member 12 to transfer the energy imparted by the gas or gas pressure 38 and gas shock waves 40 received from barrel 42 of the fired gun or weapon to energy activation means 22 to activate said energy activation means 22 by forcing movable terminal 76 in contact with stationary terminal 66. Transfer mechanism 24 is mounted for axial movement in housing member 12 and is retained therein by retainer means 82, which is ring-like in structure. Transfer mechanism 24 includes resilient means 84 positioned between a first end 86 of transfer mechanism 24 and movable terminal 76 of energy activation means 22. Resilient means 84 is critical to the operation of the domed or cupped disc of movable terminal 76. As transfer mechanism 24 is moved toward the first end 50 of housing member 12, after receiving energy transferred from the gas or gas pressure 38 and gas shock waves 40, resilient means 84 pushes against movable terminal 76. As the force increases, the dome or cupped disc starts flattening out. After a certain point is reached, a snap action occurs and the dome or cupped disc is driven into stationary terminal 66 by and because of the resiliency of resilient means 84. If the first end 86 of transfer mechanism 24 were to be used to depress the dome or cupped disc of movable terminal 76, movable terminal 76 would not move into contact with stationary terminal 66 and energy activation means 22 would not be activated by the action of the gas or gas pressure 38 and gas shock waves 40 and transfer mechanism 24. Instead, the dome or cupped disc of movable terminal 76 would be deformed to the point where energy activation means 22 would be inoperable. It will be appreciated that transfer mechanism 24 is an inert element which travels in a forward direction as a result of the force applied thereto by the gas or gas pressure 38 and the gas shock waves 40 and continues to travel forwardly as a result of the inertia gained from those forces.

Not all of the energy transferred by and from the gas or gas pressure 38 and gas shock waves 40 is needed to activate energy activation means 22. Also, the amount of energy transferred by and from the gas or gas pressure 38 and gas shock waves 40 may vary from weapon to weapon. Therefore, shock absorbing means 90 is positioned between extension 92 of transfer mechanism 24 and shoulder 94 of housing member 12 to transfer or spread the excess force or impact of energy received from the gas or gas pressure 38 and gas shock waves 40 which is not required to activate energy activation means 22, to the housing member 12. Shock absorbing means 90 may be comprised of an O-ring, a spring, etc. Shock absorbing means 90 together with shoulder 94 provide a limit of forward travel of transfer mechanism 24 and sets the threshold point of energy activation means 22.

For the greatest reliable and repeatable operation of the present invention, it is desirable that a snap-action type switch be used as the energy activation means 22. The action of other types of mechanical action switches would provide a momentary contact and would not give a reliable and repeatable firm contact with minimum electrical resistance and insure a minimum rise time of the pulse of light emitted from the housing member 12. The snap-action type switch does provide a more reliable and more repeatable firm contact with minimum electrical resistance and insures a minimum rise time of the pulse of light emitted from the housing member 12. The snap-action type switch provides a motion which is primarily controlled, both in duration and in the action of the snap, in making positive contact between the poles of the switch.

In operation with an air rifle, air gun, pellet gun, etc., the muzzle alignment tube 14 of the marksmanship training apparatus 10 is inserted into the open end or bore 41 of barrel 42 and the gun is pumped up with sufficient air pressure (or the gun is cocked if it is operated by a compressed air cartridge). There is not any need to perform any manual alignment since the marksmanship training apparatus 10 is automatically boresighted to the barrel 42. Sealing means 28 provides a seal between the muzzle alignment tube 14 and the inside of barrel 42 to minimize gas leakage around the outside surface of the muzzle alignment tube 14 and maintains the muzzle alignment tube 14 in the barrel 42 during the firing of the gun or weapon. Firing the gun releases the gas or air causing the gas or gas pressure 38 and resulting gas shock waves 40 to travel down barrel 42 and the muzzle alignment tube 14 to chamber 26 whereupon transfer mechanism 24 is moved toward the first end 50 of the marksmanship training apparatus 10 actuating energy activation means 22 closing the electrical series circuit with light energy 54 being emitted by energy emitting means 18. The electrical series circuit comprises the energy emitting means 18, holder 52, housing member 12, energy activation means 22, power source 20. It will be appreciated that the housing member 12 could be formed of an insulating material and an electrical conducting lead or wire could be connected between the energy emitting means 18 and the energy activation means 22 to complete the electrical series circuit. It will be appreciated that the muzzle alignment tube 14 will be structured in size to fit the various calibers of air guns and pellets guns, e.g., .17 caliber, .22 caliber, etc.

In operation with a weapon using blank cartridges, the muzzle alignment tube 14 of the marksmanship training apparatus 10 is inserted into the open end or bore 41 of the barrel 42, a blank cartridge is loaded into firing position and the trigger is pulled. Firing the blank cartridge causes the gas or gas pressure 38 and resulting gas shock waves 40 therefrom to move down barrel 42 and the muzzle alignment tube 14 to chamber 26 causing light energy 54 to be emitted by the energy emitting means 18 just the same as noted above for the air gun.

Figure 2:
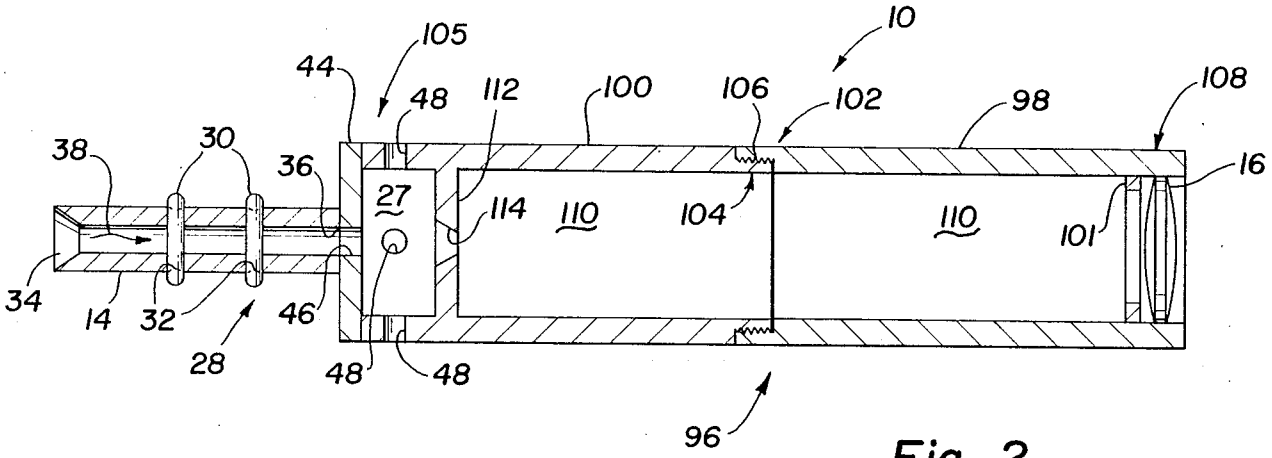
FIG. 2 is a simplified cross sectional view of an additional embodiment of the present invention.

With reference to FIG. 2, another embodiment of the marksmanship training apparatus 10 is disclosed which includes housing member 96. Housing member 96 includes a first portion 98 and a second portion 100 with an attached muzzle alignment tube 14 extending therefrom. First portion 98 and second portion 100 are removably attached together at the second end 102 of first portion 98 and the first end 104 of second portion 100 by fastening means 106. In the preferred embodiment, fastening means 106 comprises mating threaded portions. First portion 98 encloses lens means 16 and shock absorbing means 101 at a first end 108 thereof. In the preferred embodiment, shock absorbing means 101 comprises an O-ring type device against which the front edge of a substitute cartridge, similar to that disclosed in FIG. 3, rests when inserted in housing member 96.

In the preferred embodiment, housing member 96 is generally cylindrical in shape (but is not so limited to such shape) and can be formed of a plastic or metal. When first portion 98 and second portion 100 are removably attached, chamber 110 is formed thereby. Plate or wall 112 is located between second chamber 27 and first chamber 110 with second chamber 27 being located at the second end 105 of second portion 100. Plate or wall 112 includes port 114 to allow gas or gas pressure 38 and gas shock waves 40 to be conveyed to chamber 110. Housing member 96 is structured and sized such that chamber 110 will operatively accept and hold a substitute or substitute-type cartridge 116 such as disclosed in FIG. 3 and in U.S. Pat. No. 4,678,437. It will be appreciated that housing member 96 may be structured and sized such that chamber 110 will operatively accept and hold a substitute-type cartridge of any particular caliber or size which is constructed such that the substitute-type cartridge will be activated by gas or gas pressure 38 and resulting shock waves 40 and project light energy through lens means 16 toward a selected target.

Figure 3:
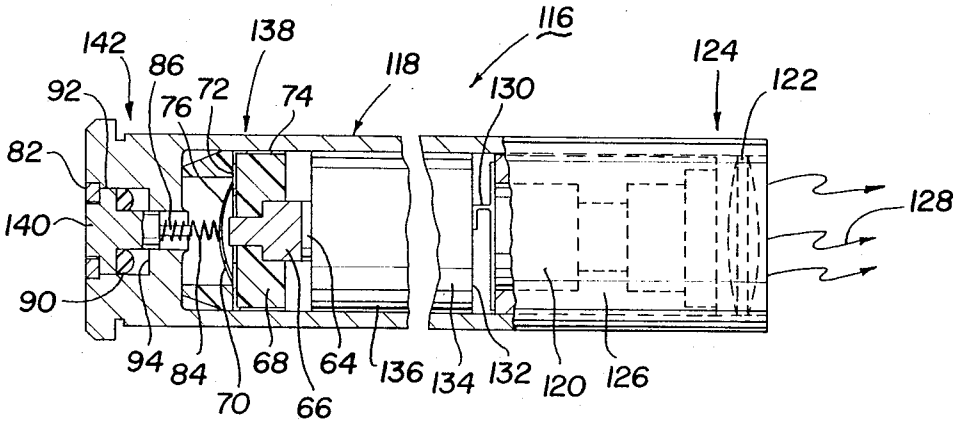
FIG. 3 is a simplified elevation view, partially in section, of a substitute cartridge for use with the embodiment of FIG. 2.

With reference to FIG. 3, an exemplary substitute or substitute-type cartridge 116 is disclosed which will fit into the proper size chamber 110 for marksmanship training. Substitute or substitute-type cartridge 116 comprises an electrically conductive cartridge casing or housing 118 which is configured and structured to fit into the cartridge chamber of a weapon. It will be apparent that the substitute cartridge 116 will be of different sizes and shapes for weapons of different calibers. The physical exterior of each caliber of substitute cartridge 116 will not be mechanically different from a "real" or "live" cartridge. An energy emitting means 120 and lens means 122 are positioned and maintained in a first end 124 of the electrically conductive cartridge casing 118 by holder 126. In the preferred embodiment, energy emitting means 120 comprises a light emitting diode which emits a pulse of light when activated. Lens means 122 is of a type which will tend to collimate and/or concentrate the light energy 128 which is emitted from energy emitting means 120.

One terminal of the energy emitting means 120 is connected to the cartridge casing 118 through the housing of the energy emitting means 120 which is mounted in a pressure fit in the holder 126. Holder 126 is electrically conductive and is mounted by conventional means such as threaded, pinned, etc. in first end 124 of cartridge casing 118. The other terminal 130 of the energy emitting means 120 is in contact with a first terminal 132 of the power source 134. Power source 134 could be any suitable battery. The power source 134 is insulated from the cartridge casing 118 by insulation 136. The second terminal of power source 134 is connected by pressure contact to energy activation means 138. In the preferred embodiment, energy activation means 138 is a snap-action type switch. When energy activation means 138 is activated, energy emitting means 120 is activated and emits a pulse or pulses of light energy 128.

Transfer mechanism 140 is positioned in the second end 142 of cartridge casing 118 to transfer the energy imparted by the gas or gas pressure 38 and gas shock waves 40 received from barrel 42 of the fired gun or weapon through port 114 to energy activation means 138 to activate same which completes the electrical circuit and energy emitting means 120 is activated.

In operation with an air rifle, air gun, pellet gun, etc., first portion 98 and second portion 100 are separated, a substitute-type cartridge 116 is inserted in chamber 110 and first portion 98 and second portion 100 are fastened together. The muzzle alignment tube 14 of the marksmanship training apparatus 10 is inserted into the open end of barrel 42 and the gun is pumped up with sufficient air pressure (or the gun is cocked if it is operated by a compressed air cartridge). Firing the gun releases the gas or air causing the gas or gas pressure 38 and resulting gas shock waves 40 to travel down barrel 42 and the muzzle alignment tube 14 to chamber 26, through port 114 whereupon transfer mechanism 140 is moved toward the first end 108 of first portion 98 actuating energy activation means 138 closing the electrical series circuit with light energy 128 being emitted by energy emitting means 120.

In operation with a weapon using blank cartridges, the muzzle alignment tube 14 of the marksmanship training apparatus 10 is inserted into the open end of the barrel 42, a blank cartridge is loaded into firing position and the trigger is pulled. Firing the blank cartridge causes the gas or gas pressure 38 and resulting gas shock waves 40 therefrom to move down barrel 42 and the muzzle alignment tube 14 to chamber 265 through port 114 causing light energy 128 to be emitted by the energy emitting means 120 just the same as noted above for the air gun.

Figure 4:
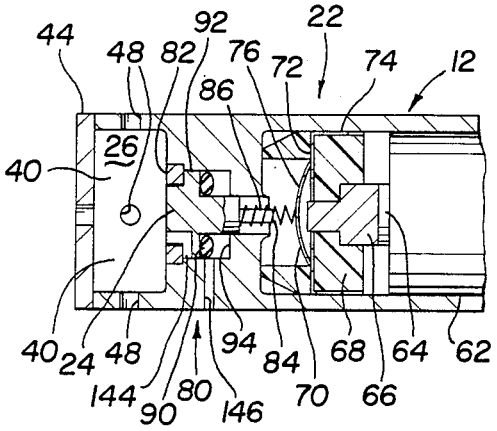
FIG. 4 is a simplified elevational view, partially in section, of a portion of the marksmanship training apparatus showing an additional embodiment of the present invention.

With reference to FIG. 4, another embodiment of the marksmanship training apparatus 10 is disclosed which includes notch 144 cut into transfer mechanism 24 and vent opening 146 which is cut through the wall of housing member 12. The purpose of this embodiment is to make the operation of the marksmanship training apparatus 10 insensitive to the force and pressure applied to the transfer mechanism 24 by the gas or gas pressure 38. As transfer mechanism 24 moves forward, notch 144 passes vent opening 146 and allows the gas or gas pressure 38 to pass more quickly to the outside of the marksmanship training apparatus 10. An additional purpose of this embodiment is to achieve a pulse characteristic of the light energy 54 emitted from the marksmanship training apparatus 10. By controlling the size and shape of the vent opening 146, the length of time the movable terminal 76 is in contact with the stationary terminal 66 of energy activation means 22 is controlled. It should be noted that this venting concept is equally applicable to the embodiment of FIGS. 2 and 3.

Figure 5:
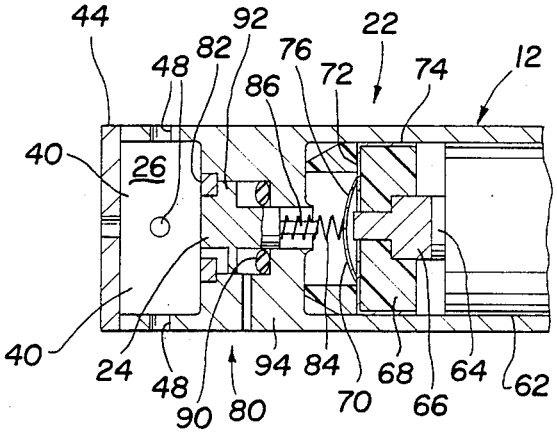
FIG. 5 is a simplified elevational view, partially in section, of a portion of the marksmanship training apparatus showing an additional embodiment of the present invention.

With reference to FIG. 5, another embodiment of the marksmanship training apparatus 10 is disclosed in which the shock absorbing means 90 is positioned on shoulder 94 to limit the forward travel of transfer mechanism 24 and to absorb or spread any excess force which might be transferred to the transfer mechanism 24.

Figure 6A:
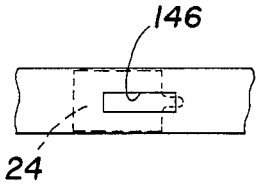
Figure 6B:
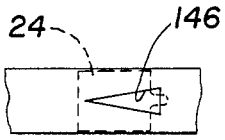

With reference to FIGS. 6*a* and 6*b*, variations of the shape of vent opening 146 are disclosed in the form of rectangular and triangular. It will be appreciated, that the vent opening 146 may take many shapes depending upon the desired time of closure of the contacts of the energy activation means 22 and the differential in pressure required for the closure and opening of the contacts.

Figure 7A:
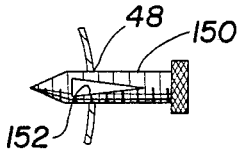
Figure 7B:
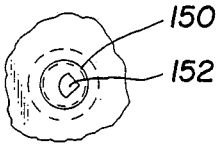

With reference to FIGS. 7*a* and 7*b*, means for adjusting the size of the opening of openings or exhaust ports 48 as well as that for vent opening 146 (when vent opening 146 is circular in shape as shown in FIG. 4) is disclosed. In the disclosed embodiment, means for adjusting 148 comprises a threaded screw 150 with a cutout 152 formed in the body thereof. In the disclosed embodiment, cutout 152 is triangular in shape. The shape and position of the cutout 152 allows more gas to escape from the marksmanship training apparatus 10 the further the threaded screw 150 is back-out of opening or exhaust port 48.

With reference to FIG. 8, an additional embodiment of the energy activation means 22 is disclosed and comprises a stationary terminal 66 and a movable terminal 154. Movable terminal 154 comprises a resilient arm 156 with a contact element 158. Resilient arm 156 is positioned such that contact element 158 makes contact with stationary terminal 66 when contacted by transfer mechanism 24. When the gas or gas pressure 38 is released, movable element 158 springs back such that contact element 158 springs back such that contact element 158 is no longer in contact with stationary terminal 66.

Although the present invention has been described in conjunction with specific forms thereof, it is evident that many alternatives, modifications and variations will be apparent to those skilled in the art insight of the foregoing disclosure. Accordingly, this description is to be contoured as illustrative only and is for the purpose of teaching those skilled in the art the manner of carrying out the invention. It is understood that the forms of the invention herewith shown and described are to be taken as the presently preferred embodiment. It will be appreciated that various modifications, alternatives, variations, etc., may be made without departing from the spirit and scope of the invention as defined in the appended claims.

What is claimed is:

1. Marksmanship training apparatus for a weapon having a barrel with a bore and a firing mechanism for causing gas to be propelled down the bore, said marksmanship training apparatus comprising:

an electrically conductive housing member having a first end and a second end;

a muzzle alignment tube having a passageway therethrough and being operatively attached to the second end of said electrically conductive housing member, said muzzle alignment tube being structured to be capable of being inserted into the bore of the barrel;

sealing means positioned around said muzzle alignment tube at a predetermined position to minimize gas being propelled down said bore from passing between the muzzle alignment tube and the bore and to prevent the muzzle alignment tube from being pushed out of said bore by said gas;

a chamber formed in the second end of said electrically conductive housing member and having an entry port to receive gas propelled down said bore and said muzzle alignment tube;

energy emitting means disposed in said electrically conductive housing member and positioned to emit energy from said first end of said electrically conductive housing member when activated;

a power source disposed within said electrically conductive housing member and connected to said energy emitting means; and energy activation means positioned within said electrically conductive housing member and electrically connected to complete an electrical circuit through said energy emitting means, said electrically conductive housing member, said power source and said energy activation means when said energy activation means is activated to the on position when said gas enters said chamber.

2. The apparatus of claim 1 further including a transfer mechanism mounted for axial movement within said electrically conductive housing member and positioned between said energy activation means and said chamber to transfer the energy imparted by said gas which enters said chamber to activate said energy activation means.

3. The apparatus of claim 1 wherein said sealing means comprises at least one O-ring operatively positioned on the outer surface of said muzzle alignment tube.

4. The apparatus of claim 1 wherein said chamber includes a predetermined number of exhaust ports formed therein to allow said gas to escape from said chamber to the outside of said chamber after said gas has caused said energy activation means to be activated to the on position.

5. The apparatus of claim 4 further including means for adjusting the size of said predetermined number of exhaust ports.

6. The apparatus of claim 2 wherein said electrically conductive housing member includes a vent opening of predetermined shape operatively positioned in the second end of said electrically conductive housing member to allow gas to escape from said marksmanship training apparatus upon the movement of said transfer mechanism past said vent opening.

7. The apparatus of claim 6 further including means for adjusting the size of said vent opening.

8. The apparatus of claim 2 wherein said energy activation means comprises a snap action switch including a stationary terminal which is electrically connected to said power source and a movable terminal which is positioned to be contacted by said transfer mechanism and moved to contact said stationary terminal to activate said energy activation means.

9. The apparatus of claim 8 wherein said movable terminal comprises a disc which is rigidly supported around the periphery thereof and includes a cupped portion which protrudes from said periphery in the direction of said transfer mechanism.

10. The apparatus of claim 9 wherein said transfer mechanism includes resilient means which is positioned in contact with said cupped portion of said disc.

11. The apparatus of claim 1 wherein said emitted energy is in the form of light.

12. The apparatus of claim 2 further including shock absorbing means positioned to be contacted by said transfer mechanism when said transfer mechanism is moved by said gas to activate said energy activation means.

13. The apparatus of claim 1 further including lens means positioned at said first end of said electrically conductive housing member to collimate said energy emitted from said energy emitting means.

14. Marksmanship training apparatus for a weapon having a barrel with a bore and a firing mechanism for causing gas to be propelled down the bore, said marksmanship training apparatus comprising:

a housing member having a first portion and a second portion, said first portion and said second portion structured to be removably attached to form a first chamber therewithin, said first portion and said second portion each having a first end and a second end;

a muzzle alignment tube having a passageway therethrough and being operatively attached to the second end of said second portion, said muzzle alignment tube structured to be capable of being inserted into the bore of the barrel;

sealing means positioned around said muzzle alignment tube at a predetermined position to prevent gas being propelled down said bore from passing between the muzzle alignment tube and the bore and to prevent the muzzle alignment tube from being pushed out of said bore by said gas; and a second chamber formed in the second end of said second portion and having an entry port to receive gas propelled down said bore and said muzzle alignment tube and an exit port to allow said gas to flow to said first chamber.

15. The apparatus of claim 14 wherein said sealing means comprises at least one O-ring operatively positioned on the outer surface of said muzzle alignment tube.

16. The apparatus of claim 14 wherein said first chamber is structured to accept a substitute cartridge whose physical exterior is generally the same shape as that of a real cartridge.

17. The apparatus of claim 14 wherein said second chamber includes a predetermined number of exhaust ports formed therein to allow said gas to escape from said chamber to the outside of said chamber.

18. The apparatus of claim 17 further including means for adjusting the size of said predetermined number of exhaust ports.

19. The apparatus of claim 14 further including lens means positioned at said first end of said first portion.

20. The apparatus of claim 14 further including shock absorbing means operatively positioned at said first end of said first portion.

* * * * *